US011631511B2

(12) United States Patent
Bai et al.

(10) Patent No.: US 11,631,511 B2
(45) Date of Patent: Apr. 18, 2023

(54) THERMISTOR CHIP AND PREPARATION METHOD THEREOF

(71) Applicant: DINGSENSE ELECTRONICS TECHNOLOGY CO., LTD, Zhaoqing (CN)

(72) Inventors: Xiaohai Bai, Zhaoqing (CN); Mengtian Yang, Zhaoqing (CN); Limin Tang, Zhaoqing (CN); Qixing Bai, Zhaoqing (CN); Jun Yang, Zhaoqing (CN); Zhaoxiang Duan, Zhaoqing (CN)

(73) Assignee: DINGSENSE ELECTRONICS TECHNOLOGY CO., LTD, Zhaoqing (CN)

( * ) Notice: Subject to any disclaimer, the term of this patent is extended or adjusted under 35 U.S.C. 154(b) by 114 days.

(21) Appl. No.: 17/417,233

(22) PCT Filed: Jul. 8, 2019

(86) PCT No.: PCT/CN2019/094975

§ 371 (c)(1),
(2) Date: Jun. 22, 2021

(87) PCT Pub. No.: WO2020/134014

PCT Pub. Date: Jul. 2, 2020

(65) Prior Publication Data

US 2022/0059260 A1 Feb. 24, 2022

(30) Foreign Application Priority Data

Dec. 28, 2018 (CN) ..... 201811617192.5

(51) Int. Cl.
*H01C 7/04* (2006.01)
*H01C 1/14* (2006.01)
(Continued)

(52) U.S. Cl.
CPC ..... *H01C 7/041* (2013.01); *H01C 1/1413* (2013.01); *H01C 17/006* (2013.01); *H01C 17/065* (2013.01)

(58) Field of Classification Search
CPC .... H01C 7/041; H01C 1/1412; H01C 17/006; H01C 17/065
See application file for complete search history.

(56) References Cited

U.S. PATENT DOCUMENTS

2005/0116344 A1* 6/2005 Humpston ..... B81B 7/007 257/750
2006/0030139 A1* 2/2006 Mis ..... H01L 24/03 257/E23.021

FOREIGN PATENT DOCUMENTS

CN 101067981 A 11/2007
CN 102627446 A 8/2012
(Continued)

OTHER PUBLICATIONS

JP 2002110923, machine translation. (Year: 2002).*
(Continued)

*Primary Examiner* — Kyung S Lee
(74) *Attorney, Agent, or Firm* — Schmeiser, Olsen & Watts, LLP

(57) ABSTRACT

A thermistor chip is provided, which includes a thermosensitive ceramic substrate, a surface electrode and a bottom electrode. The surface electrode and the bottom electrode are respectively arranged on the two surfaces of the thermosensitive ceramic substrate. The surface electrode is a silver layer. The bottom electrode consists of a silver layer, a titanium-tungsten alloy layer, a copper layer and a gold layer, laminating on the thermosensitive ceramic substrate in turn from inside to outside. A preparation method thereof is also provided. The thermistor chip can meet the requirements of both solder paste reflow soldering and wire bond-
(Continued)

ing process simultaneously, and has the advantages of good bonding effect and high temperature resistance, high reliability and high stability.

15 Claims, 3 Drawing Sheets

(51) Int. Cl.
*H01C 17/00* (2006.01)
*H01C 17/065* (2006.01)

(56) References Cited

FOREIGN PATENT DOCUMENTS

| | | | | | |
|---|---|---|---|---|---|
| CN | 105913987 | A | | 8/2016 | |
| CN | 106197726 | A | | 12/2016 | |
| CN | 106298120 | A | | 1/2017 | |
| CN | 109659104 | A | | 4/2019 | |
| CN | 109659134 | A | | 4/2019 | |
| CN | 109712811 | A | | 5/2019 | |
| CN | 109727738 | A | | 5/2019 | |
| DE | 102019120017 | A1 | * | 1/2021 | ..... H01L 23/427 |
| EP | 0 657 898 | A1 | | 6/1995 | |
| JP | 2002110923 | A | * | 4/2002 | ..... H01L 23/427 |
| JP | 2010272737 | A | | 12/2010 | |

OTHER PUBLICATIONS

DE 102019120017, machine translation. (Year: 2006).*
International Search Report dated Aug. 28, 2019 for PCT/CN2019/094975.

* cited by examiner

THERMISTOR CHIP AND PREPARATION METHOD THEREOF

CROSS-REFERENCE TO RELATED APPLICATIONS

This application claims priority to PCT Application No. PCT/CN2019/094975 filed on Jul. 8, 2019, which claims priority to Chinese Patent Application No. 201811617192.5 filed on Dec. 28, 2018, the entire contents both of which are hereby incorporated by reference.

FIELD OF TECHNOLOGY

The following relates to the technical field of electronic components, in particular to a thermistor chip and a preparation method thereof.

BACKGROUND

Thermistor chips are widely used in various temperature detection, temperature compensation and temperature control circuits, the core function of which is to convert temperature variables into required electronic signals in the circuits.

As shown in FIG. 1, an existing thermistor chip includes a thermosensitive ceramic substrate 1', a surface electrode 2' and a bottom electrode 3'. The surface electrode 2' and the bottom electrode 3' are arranged on two surfaces of the thermosensitive sensitive ceramic substrate 1' respectively, which are both made of the same metal, for example, silver or gold. The thermosensitive ceramic substrate 1', the surface electrode 2' and the bottom electrode 3' of the thermistor chip are all sintered at temperatures over 800° C., so the actual temperature resistance of the thermistor chip in use is usually determined by the temperature resistance of the welding material between it and the applied circuit module.

Currently, minimal size and rapid speed are required in the application of thermistor chips in IGBT, infrared thermopile and other modules. Therefore, the process of bonding thermistor chips is adopted, which is to install the chips on a circuit board and realize the electrical connection between the circuit inside the chips and the circuit board.

In the conventional thermistor chip bonding process, the bottom electrode of thermistor chip is pasted on the circuit board by silver glue with low temperature resistance, and the surface electrode of thermistor chip is connected with the solder pad on the circuit board via bonding aluminum wire, copper wire or gold wire. Since the curing temperature of the silver glue is about 100° C., the temperature resistance of the cured silver glue is not more than 150° C., so the temperature resistance of the existing thermistor chip is not more than 150° C., which may not meet the requirement of high temperature working environment.

The solder paste reflow soldering process is often used for soldering SMT circuit boards ("SMT" is the abbreviation of "Surface Mounted Technology"), which has the advantages of high accuracy, efficiency, stability and reliability. Compared with the silver glue with low temperature resistance, the temperature resistance of the tin solder can reach 260° C., so the solder paste technology applied in the bonding process of the thermistor chip can significantly improve the heat resistance of the thermistor chip.

However, there are following problems for the thermistor chip with homogeneous electrodes on two surfaces in the actual application of the solder paste reflow soldering in the bonding process. For the chip with silver electrodes used on both sides, the silver surface electrode is suitable for bonding with aluminum wire, copper wire or gold wire, of which the welding effect is good. But silver-eating phenomenon (i.e. silver migration) happens when the silver bottom electrode is soldered on the circuit board by solder paste reflow soldering. A slight silver migration will cause a sudden change in the electrical performance of the chip and a decrease in its reliability. When the silver migration is serious, there is no silver adhering to the bottom surface of the chip, the ceramic body exposed, the chip and circuit board separated after soldering, which leads to product failure. In addition, when silver and tin are soldered together, a tin-silver alloy is formed, which will change the electrode performance of the chip, while using gold on both electrodes of the chip will increase the cost greatly.

SUMMARY

An aspect relates to a high temperature resistant thermistor chip with composite heterogeneous electrodes on two surfaces, which can meet the requirements of both solder paste reflow soldering and wire bonding process simultaneously, and has the advantages of good bonding effect and high temperature resistance, high reliability and high stability.

The technical solution adopted in embodiments is as follows:

A thermistor chip, comprising a thermosensitive ceramic substrate, a surface electrode and a bottom electrode, and the surface electrode and the bottom electrode are arranged on the two surfaces of the thermosensitive ceramic substrate respectively, wherein the surface electrode is a silver layer; the bottom electrode consists of a silver layer, a titanium-tungsten alloy layer, a copper layer and a gold layer, laminating on the thermosensitive ceramic substrate in turn from inside to outside.

In some embodiments, a thickness of the silver layer of the bottom electrode is 4~7 microns, a thickness of the titanium-tungsten alloy layer is 0.1~0.15 microns, a thickness of the copper layer is 0.1~0.2 microns, and a thickness of the gold layer is 0.25~0.55 microns.

In some embodiments, a mass ratio of titanium to tungsten of the titanium-tungsten alloy layer of the bottom electrode is 1:9.

In some embodiments, a thickness of the silver layer of the surface electrode is 4~7 microns.

In some embodiments, the silver layers of the surface electrode and the bottom electrode are both formed by printing silver paste on the thermosensitive ceramic substrate and sintering at a high temperature; the titanium-tungsten alloy layer, the copper layer and the gold layer of the bottom electrode are all formed by sputtering.

Embodiments of the disclosure also disclose a method of preparing any one of the above high temperature resistant thermistor chips with composite heterogeneous electrodes on two surfaces, including the following steps: arranging a silver layer, a titanium-tungsten alloy layer, a copper layer, and a gold layer sequentially on one surface of a thermosensitive ceramic sheet, arranging a silver layer on the other surface of the thermosensitive ceramic sheet, and then cutting the thermosensitive ceramic sheet into single thermistor chips.

In some embodiments, the method includes the following steps:

S1: printing silver paste on both surfaces of the thermosensitive ceramic sheet, and then sintering at a high temperature to obtain the thermosensitive ceramic sheet with a silver layer printed on both surfaces;

S2: sputtering sequentially a titanium-tungsten alloy layer, a copper layer and a gold layer on the silver layer on one surface of the thermosensitive ceramic sheet obtained from Step S1;

S3: testing a resistivity of the thermosensitive ceramic sheet obtained from Step S2, calculating a size of the single thermistor chip according to the test result and required resistance of the thermistor chip, and then cutting the thermosensitive ceramic sheet into single thermistor chips.

In some embodiments, in Step S1, the sintering temperature is 850~870° C., and the holding time of the sintering is 15 minutes. Through high-temperature sintering, the glass powder in the silver paste melts and penetrates into the thermosensitive ceramic substrate to form a strong bonding layer.

In some embodiments, in Step S2, a vacuum sputtering coating machine is used to sequentially sputter the titanium-tungsten alloy layer, the copper layer and the gold layer under a condition that argon gas is used as a working gas.

In some embodiments, in Step S2, before sputtering, the thermosensitive ceramic sheet is put into a plasma cleaning machine for cleaning and activating the surfaces.

For a better understanding and implementation, embodiments of the disclosure will be described in detail below in combination with accompanying drawings.

BRIEF DESCRIPTION

Some of the embodiments will be described in detail, with reference to the following figures, wherein like designations denote like members, wherein.

DETAILED DESCRIPTION

Figure 1:
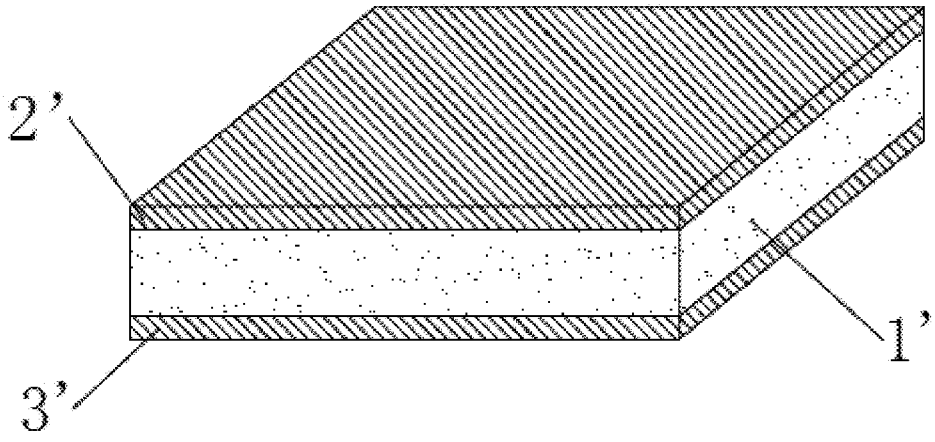
FIG. 1 is a schematic diagram of an existing thermistor chip with homogeneous electrodes on two surfaces.
Figure 2:
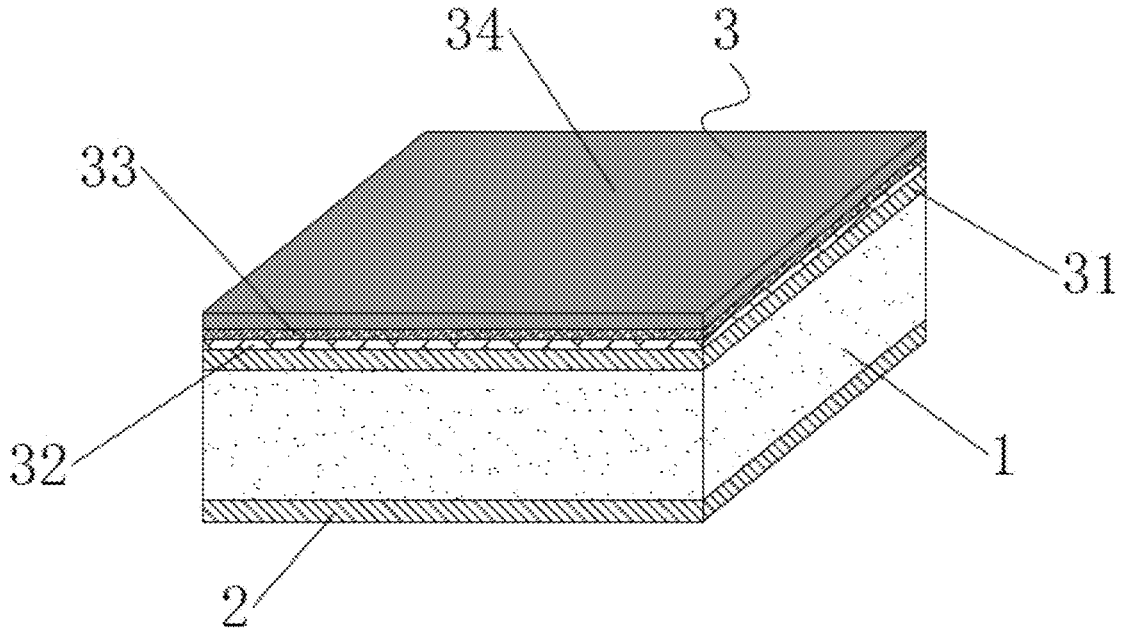
FIG. 2 is a schematic diagram of a thermistor chip in one or more embodiments of the present disclosure.

Referring to FIG. 2, which is a schematic diagram of a thermistor chip in one or more embodiments of the present disclosure.

The thermistor chip includes a thermosensitive ceramic substrate 1, a surface electrode 2 and a bottom electrode 3. In FIG. 2, the surface electrode 2 is below and the bottom electrode 3 is above, in order to fully show the bottom electrode 3. The surface electrode 2 and the bottom electrode 3 are respectively arranged on the two surfaces of the thermosensitive ceramic substrate 1. The surface electrode 2 is a silver layer. The bottom electrode 3 is composed of a silver layer 31, a titanium-tungsten alloy layer 32, a copper layer 33 and a gold layer 34. The silver layer 31, titanium-tungsten alloy layer 32, copper layer 33 and gold layer 34 are laminated on the thermosensitive ceramic substrate 1 from inside to outside.

The surface electrode is used for wire bonding, and the bottom electrode is used for soldering on a circuit board. The silver layers (Ag) of the surface electrode and the bottom electrode are used as the base layers to combine with the thermosensitive ceramic substrate, which can form a strong bond with the thermosensitive ceramic substrate, and the silver layer of the surface electrode can be well bonded with aluminum wire, copper wire or gold wire. The titanium-tungsten alloy layer (TiW) of the bottom electrode acts as a transition layer, which makes the silver layer and the copper layer better combined and has a blocking effect. The copper layer (Cu) of the bottom electrode is used as a blocking layer to prevent the external damage to the transition layer and has welding function. The gold layer (Au) of the bottom electrode is not only a welding layer, but also a protective layer, which is very stable and high temperature resistant, and can prevent oxidation, corrosion, damage, and silver migration. The gold layer meets the technological requirements of solder paste reflow soldering, it effectively prevents tin solder from penetrating into the silver layer to form a tin-silver alloy and avoid silver migration during the process of solder paste reflow soldering, thereby preventing the solder paste from damaging the silver layer.

Compared with the known art, the bottom electrode of the thermistor chip of the disclosure is appropriate for solder paste reflow soldering, because the temperature resistance of the solder can reach 260° C., and the temperature resistance of the high temperature tin solder can reach over 300° C. Therefore, the temperature resistance of the thermistor chip is above 260° C. Meanwhile the silver layer of the surface electrode can be well bonded and welding with aluminum wire, gold wire or copper wire, and the wire does not fall off after bonding. Moreover, the disclosure can effectively improve the stability, temperature resistance, corrosion resistance and destruction resistance of the thermistor chip by stacking the silver layer, the titanium-tungsten alloy layer, the copper layer and the gold layer from inside to outside the bottom electrode, which not only improve the reliability greatly, but also control the electrode material cost of the chip.

In addition, since a variety of electronic components including resistors, capacitors, inductors, etc. are used in integrated circuits, and these devices are all surface mounted products, where usually only solder paste reflow soldering process will be used for bonding. The bottom surface of the thermistor chip of the disclosure satisfies the reflow soldering process requirements, therefore it can be assembled with other devices to realize one-time reflow soldering, which improves the production efficiency of integrated circuits.

In some embodiments, the thickness of the silver layer 31 is 4~7 microns, the thickness of the titanium-tungsten alloy layer 32 is 0.1~0.15 microns, the thickness of the copper layer 33 is 0.1~0.2 microns, and the thickness of the gold layer 34 is 0.25~0.55 microns.

By limiting the thickness range of each metal layer of the bottom electrode, the material cost can be controlled while ensuring the electrical performance and the reliability. Tests have verified that the electrical performance and reliability of products made according to these thickness ranges have reached the highest level.

If the silver layer is too thick, it will not be closely combined with the thermosensitive ceramic substrate which reduces the product reliability, and it is easy to peel and curl when cutting, and the cost is high. Meanwhile if the silver layer is prepared by silver paste printing and the silver layer is too thick, the glass in the silver paste will penetrate into the thermosensitive ceramic substrate too much to reduce the product reliability. However if the silver layer is too thin, the surface porosity will be high, which reduces both product reliability and performance qualification rate.

The titanium-tungsten alloy layer and the copper layer are blocking layers. If they are too thick, they will not bond well with the innermost silver layer and are easy to delaminate due to high stress during cutting. If they are too thin, they cannot play a blocking role.

The gold layer is not only a welding layer but also a protective layer. If the gold layer is too thin, the electrical properties of the product will be low which reduces the product reliability, and it will not be protective. If the gold layer is too thick, the cost will be too high, and it will cause the gold layer to curl and peel when the product is sliced and cut, which affects product appearance and reduces reliability.

The mass ratio of titanium to tungsten is 1:9 in the titanium-tungsten alloy layer 32. The expansion coefficient of the titanium-tungsten alloy layer with this composition is substantially the same as that of the thermosensitive ceramic substrate, so that the bottom electrode can maintain well combination with the thermosensitive ceramic substrate, and the combination of the titanium-tungsten alloy layer with the silver layer and the copper layer are also better.

The thickness of the silver layer of the surface electrode 2 is 4~7 microns. If the silver layer is too thick, it will not be closely combined with the thermosensitive ceramic substrate which reduces the product reliability, and it is easy to peel and curl when cutting, and the cost is high. Meanwhile if the silver layer is prepared by silver paste printing and the silver layer is too thick, the glass in the silver paste will penetrate into the thermosensitive ceramic substrate too much to reduce the product reliability. However if the silver layer is too thin, the surface porosity will be high, which reduces both product reliability and performance qualification rate.

The silver layer of the surface electrode 2 and the silver layer 31 of the bottom electrode 3 are formed by printing silver paste and sintering at a high temperature. The titanium-tungsten alloy layer 32, the copper layer 33 and the gold layer 34 are all formed by sputtering. Through high-temperature sintering, the glass powder in the silver paste melts and penetrates into the thermosensitive ceramic to form a strong bonding layer. The titanium-tungsten alloy layer, the copper layer and the gold layer made by sputtering are very dense and have strong anti-damage ability, which brings higher reliability.

Figure 3:
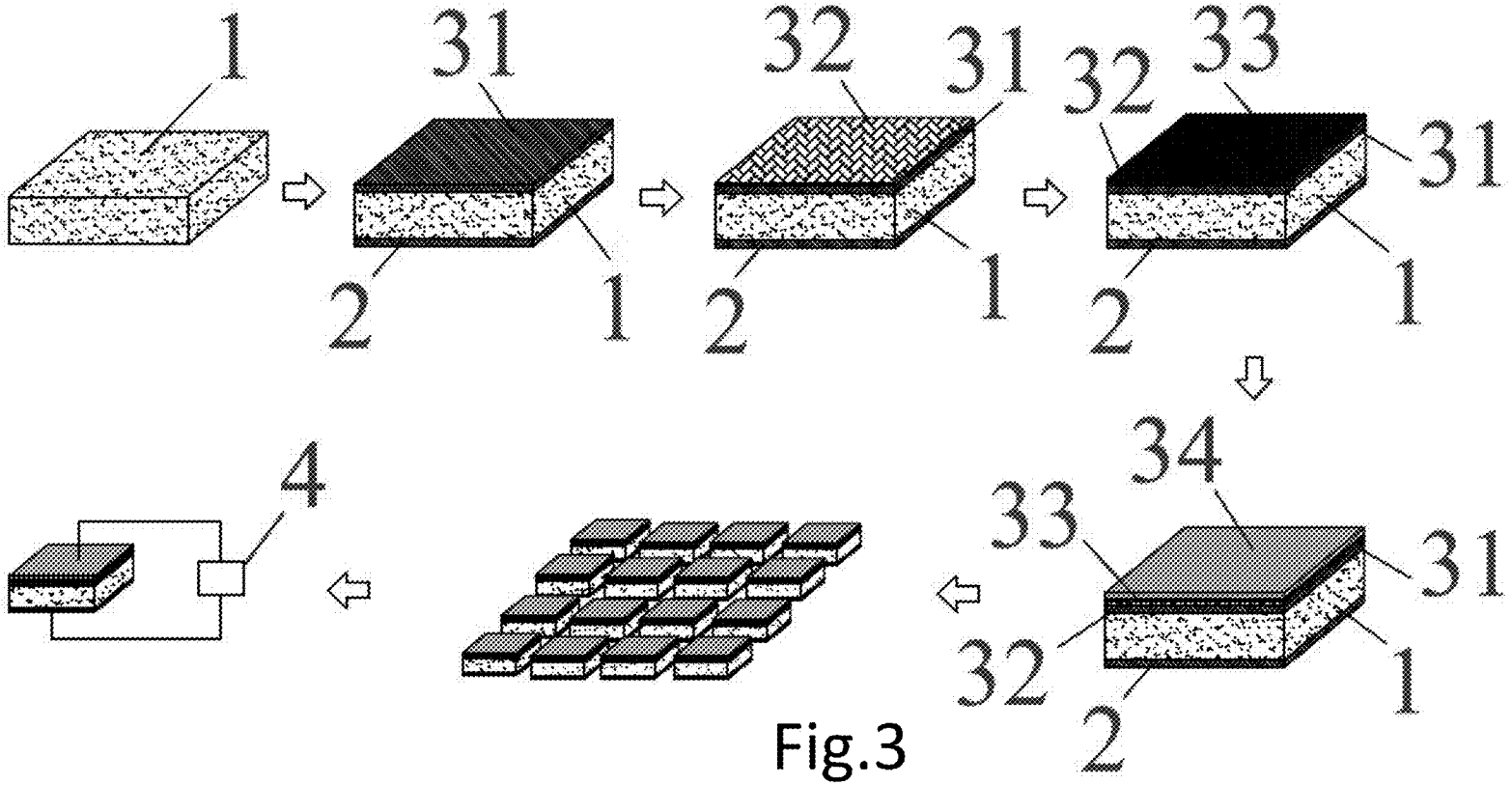
FIG. 3 is a preparation flow chart of a thermistor chip in one or more embodiments of the present disclosure.
Figure 4:
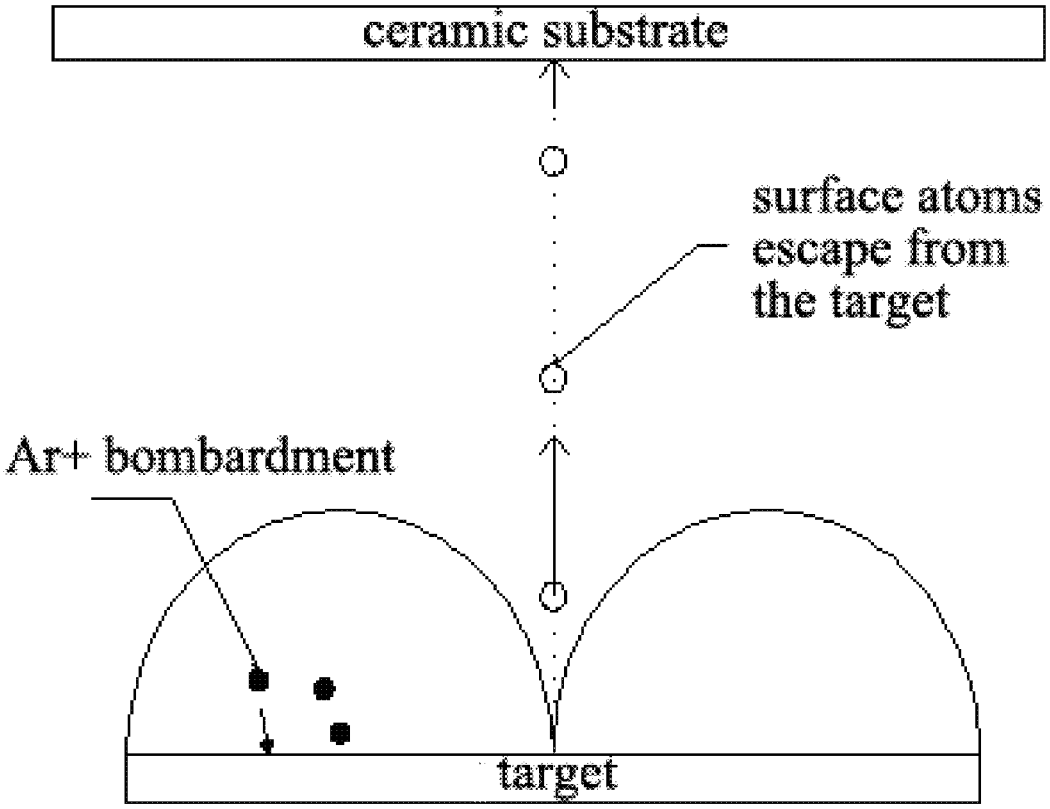
FIG. 4 is a schematic diagram of vacuum sputtering.

Referring to FIGS. 3 and 4, FIG. 3 is a preparation flow chart of a thermistor chip in one or more embodiments of the present disclosure, and FIG. 4 is a schematic diagram of vacuum sputtering.

A method of preparing the thermistor chip including the following steps:

S1: Printing silver paste on two surfaces of thermosensitive ceramic sheet, and then sintering at a high temperature to obtain the thermosensitive ceramic sheet with a silver layer printed on both surfaces.

In some embodiments, the thermosensitive ceramic sheet is made of NTC thermosensitive ceramic powder ("NTC" is the abbreviation of "negative temperature coefficient") through pressing, sintering and slicing; the sintering temperature is 850~870° C., and the holding time of the sintering is 15 minutes; the thickness of the silver layer printed on both surfaces of the thermosensitive ceramic substrate is 4-7 microns, desirably 5 microns.

S2: Sputtering sequentially a titanium-tungsten alloy layer 32, a copper layer 33 and a gold layer 34 on the silver layer 31 on one surface of the thermosensitive ceramic sheet obtained from Step S1. The Step S2 specifically includes below detailed steps:

S21: First cleaning.

Washing the thermosensitive ceramic sheet obtained from Step S1 with cleaning liquid, then cleaning by ultrasonic machine, and then drying. The washing time is 5±1 minutes. The drying temperature is 100±5° C. and the drying time is 30±5 minutes.

S22: Second cleaning.

Putting the thermosensitive ceramic sheet obtained from the first cleaning of Step S21 into a plasma cleaning machine for cleaning and then drying. The cleaning time is 5±1 minutes, the drying temperature is 100±5° C., and the drying time is 30±5 minutes while activating the surfaces.

S23: Sputtering a titanium-tungsten alloy layer 32.

First the vacuum sputtering coating machine is evacuated to the working range, then argon is filled as the working gas, and the titanium-tungsten alloy with a mass ratio of 1:9 of titanium to tungsten is used as the target. Under the action of an electric field, Ar+ accelerates and bombards the target to sputter the target atoms onto the thermosensitive ceramic sheet obtained from Step S22. A titanium-tungsten alloy layer 32 sputtered on the surface of one silver layer 31 of the thermosensitive ceramic sheet is formed, with a sputtering thickness of 0.1~0.15 microns.

S24: Sputtering a copper layer 33.

First the vacuum sputtering coating machine is evacuated to the working range, then argon is filled as the working gas, and copper is used as the target. Under the action of an electric field, Ar+ accelerates and bombards the target to sputter the target atoms onto the thermosensitive ceramic sheet obtained from Step S23. A copper layer 33 sputtered on the surface of the titanium-tungsten alloy layer 32 obtained from Step S23 is formed, with a sputtering thickness of 0.1~0.2 microns.

S25: Sputtering a gold layer 34.

First the vacuum sputtering coating machine is evacuated to the working range, then argon is filled as the working gas, and gold is used as the target. Under the action of an electric field, Ar+ accelerates and bombards the target to sputter the target atoms onto the thermosensitive ceramic sheet obtained from Step S24. A gold layer 34 sputtered on the surface of the copper layer 33 obtained from Step S24 is formed, with a sputtering thickness of 0.25~0.55 microns.

S3: Testing the resistivity of the thermosensitive ceramic sheet obtained from Step S2, calculating the size of a single thermistor chip according to the test result and the required resistance of the thermistor chip, and then cutting the thermosensitive ceramic sheet into single thermistor chips.

S4: Testing and sorting.

Testing resistance values of the thermistor chips obtained by mass production from Step S3 one by one via a thermistor tester 4, sorting and eliminating products that do not meet the requirements.

Reliability tests were performed on the existing thermistor chip with two silver electrodes with a designed resistance of 10 KΩ and the thermistor chip of the present disclosure with a designed resistance of 10 KΩ, including high temperature aging test, thermal shock test and thrust test of reflow soldering.

(1) High temperature aging test: the thermistor chip samples were placed in an oven at 250±5° C. for aging for 1000 hours. The resistance values of the samples before and after the test were measured and the change rates of the resistance values were calculated. The comparison results are showed in Table 1.

TABLE 1

| 250 °C./1000H High Temperature Aging Test Comparison Results | | | | | | | |
|---|---|---|---|---|---|---|---|
| existing thermistor chip with two silver electrodes | | | | thermistor chip of the present disclosure | | | |
| sample number | before (KΩ) | after (KΩ) | change rate | sample number | before (KΩ) | after (KΩ) | Change rate |
| 1 | 9.98 | 10.23 | 2.5% | 1 | 9.95 | 9.97 | 0.20% |
| 2 | 10.00 | 10.15 | 1.5% | 2 | 9.92 | 9.95 | 0.30% |
| 3 | 10.07 | 10.22 | 1.5% | 3 | 9.96 | 9.99 | 0.30% |
| 4 | 9.92 | 10.02 | 1.0% | 4 | 9.98 | 10.01 | 0.30% |
| 5 | 9.88 | 10.00 | 1.2% | 5 | 10.01 | 10.03 | 0.20% |
| 6 | 10.05 | 10.27 | 2.2% | 6 | 10.04 | 10.05 | 0.10% |
| 7 | 10.30 | 10.46 | 1.6% | 7 | 10.00 | 10.02 | 0.20% |
| 8 | 9.97 | 10.15 | 1.8% | 8 | 9.88 | 9.90 | 0.20% |
| 9 | 9.92 | 10.07 | 1.5% | 9 | 10.00 | 10.02 | 0.16% |
| 10 | 10.01 | 10.12 | 1.1% | 10 | 10.06 | 10.08 | 0.20% |
| 11 | 10.00 | 10.09 | 0.9% | 11 | 9.84 | 9.87 | 0.30% |
| 12 | 9.90 | 10.04 | 1.4% | 12 | 9.92 | 9.95 | 0.30% |
| 13 | 9.93 | 10.11 | 1.8% | 13 | 10.08 | 10.10 | 0.20% |
| 14 | 10.10 | 10.30 | 2.0% | 14 | 10.10 | 10.13 | 0.30% |
| 15 | 10.02 | 10.16 | 1.4% | 15 | 9.89 | 9.91 | 0.20% |
| 16 | 10.05 | 10.20 | 1.5% | 16 | 9.94 | 9.96 | 0.20% |
| 17 | 9.94 | 10.04 | 1.0% | 17 | 10.06 | 10.08 | 0.20% |
| 18 | 9.97 | 10.16 | 1.9% | 18 | 10.00 | 10.00 | 0.00% |
| 19 | 9.91 | 10.00 | 0.9% | 19 | 10.08 | 10.11 | 0.30% |
| 20 | 10.05 | 10.21 | 1.6% | 20 | 9.90 | 9.93 | 0.30% |

(2) Thermal shock test: The thermistor chip samples were placed at −40° C. (in air) for 5 minutes→at room temperature for 1 minute→at 150° C. (in air) for 5 minutes. Such cycle was carried out 1000 times successively. The resistance values of the samples before and after the test were measured and the change rates of the resistance values were calculated. The comparison results are showed in Table 2.

TABLE 2

| 40° C./150° C. Thermal Test Comparison Results | | | | | | | |
|---|---|---|---|---|---|---|---|
| existing thermistor chip with two silver electrodes | | | | thermistor chip of the present disclosure | | | |
| sample number | before (KΩ) | after (KΩ) | change rate | sample number | before (KΩ) | after (KΩ) | change rate |
| 1 | 10.15 | 10.05 | −0.99% | 1 | 9.97 | 9.96 | −0.10% |
| 2 | 9.90 | 9.80 | −1.01% | 2 | 9.96 | 9.95 | −0.10% |
| 3 | 9.86 | 9.75 | −1.12% | 3 | 10.01 | 9.995 | −0.10% |
| 4 | 10.05 | 9.88 | −1.69% | 4 | 10.00 | 9.998 | −0.10% |
| 5 | 10.08 | 9.91 | −1.67% | 5 | 9.90 | 9.89 | −0.10% |
| 6 | 9.92 | 9.77 | −1.51% | 6 | 9.93 | 9.920 | −0.10% |
| 7 | 10.10 | 9.90 | −1.98% | 7 | 10.46 | 10.45 | −0.10% |
| 8 | 10.00 | 9.89 | −1.10% | 8 | 10.05 | 10.05 | −0.0% |
| 9 | 10.06 | 9.86 | −1.99% | 9 | 10.11 | 10.11 | −0.00% |
| 10 | 9.94 | 9.78 | −1.61% | 10 | 10.12 | 10.11 | −0.1% |
| 11 | 9.91 | 9.70 | −2.12% | 11 | 9.98 | 9.98 | 0.00% |
| 12 | 10.02 | 9.85 | −1.70% | 12 | 10.04 | 10.03 | −0.10% |
| 13 | 10.07 | 9.76 | −3.08% | 13 | 9.91 | 9.90 | −0.10% |
| 14 | 10.00 | 9.73 | −2.70% | 14 | 9.96 | 9.95 | −0.10% |
| 15 | 9.90 | 9.82 | −0.81% | 15 | 10.08 | 10.07 | −0.1% |
| 16 | 9.88 | 9.68 | −2.02% | 16 | 9.88 | 9.88 | 0.00% |
| 17 | 9.85 | 9.65 | −2.03% | 17 | 10.00 | 9.99 | −0.09% |
| 18 | 9.96 | 9.69 | −2.71% | 18 | 10.06 | 10.055 | −0.1% |
| 19 | 9.99 | 9.88 | −1.10% | 19 | 9.88 | 9.87 | −0.10% |
| 20 | 9.97 | 9.79 | −1.81% | 20 | 9.92 | 9.91 | −0.1% |

(3) Thrust Test of Reflow Soldering: After the thermistor chip samples were soldered on a circuit board via solder paste reflow soldering, the thrust (bonding strength) needed by the solder joint to fall off was measured by a push-pull force meter, in Newton (N). The comparison results are showed in Table 3.

TABLE 3

| Reflow Soldering Thrust Test Comparison Results | | | |
|---|---|---|---|
| existing thermistor chip with two silver electrodes | | thermistor chip of the present disclosure | |
| Sample number | thrust (N) | Sample number | thrust (N) |
| 1 | 2.1 | 1 | 6.8 |
| 2 | 2 | 2 | 6.3 |
| 3 | 1.98 | 3 | 6.5 |
| 4 | 2.5 | 4 | 6.8 |
| 5 | 1.9 | 5 | 6.6 |
| 6 | 1.98 | 6 | 6.1 |
| 7 | 2.2 | 7 | 6.4 |
| 8 | 2.3 | 8 | 6.4 |
| 9 | 2.4 | 9 | 6.5 |
| 10 | 2.1 | 10 | 6.6 |

According to the above reliability tests data, compared with the existing thermistor chip with two silver electrodes, the thermistor chip with composite heterogeneous electrodes on two surfaces of the disclosure has significantly better high temperature resistance, of which the value change rate under 250° C. is only 0.3% at most. And it is obviously more resistant to thermal shock. The resistance change rate under the thermal shock of −40° C./150° C. is only 0.1% at most. Meanwhile it is more suitable for solder paste reflow soldering, of which the bond strength is significantly higher and the thrust can reach 6.8N.

The thermistor chip of the present disclosure can meet both soldering requirements of solder paste reflow soldering and wire bonding process. And the comparison data of the above reflow soldering thrust test shows that the electrode layers of the thermistor chip after reflow soldering is not damaged by tin alloy, and the soldering is firm, which has the advantages of stable electrical performance. Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

What is claimed:

1. A thermistor chip, comprising a thermosensitive ceramic substrate, a surface electrode and a bottom electrode, and the surface electrode and the bottom electrode are arranged on the two surfaces of the thermosensitive ceramic substrate respectively, wherein the surface electrode is a silver layer; the bottom electrode consists of a silver layer, a titanium-tungsten alloy layer, a copper layer and a gold layer, laminating on the thermosensitive ceramic substrate in turn from inside to outside.

2. The thermistor chip of claim 1, wherein a thickness of the silver layer of the bottom electrode is 4~7 microns, a thickness of the titanium-tungsten alloy layer is 0.1~0.15 microns, a thickness of the copper layer is 0.1~0.2 microns, and a thickness of the gold layer is 0.25~0.55 microns.

3. The thermistor chip of claim 1, wherein a mass ratio of titanium to tungsten of the titanium-tungsten alloy layer of the bottom electrode is 1:9.

4. The thermistor chip of claim 1, wherein a thickness of the silver layer of the surface electrode is 4-7 microns.

5. The thermistor chip of claim 1, wherein the silver layers of the surface electrode and the bottom electrode are both formed by printing silver paste on the thermosensitive ceramic substrate and sintering.

6. A method of preparing the thermistor of claim 1, comprising the following steps: arranging a silver layer, a titanium-tungsten alloy layer, a copper layer, and a gold layer sequentially on one surface of a thermosensitive ceramic sheet, arranging a silver layer on the other surface of the thermosensitive ceramic sheet, and then cutting the thermosensitive ceramic sheet into single thermistor chips.

7. The method of claim 6, comprising

S1: printing silver paste on both surfaces of the thermosensitive ceramic sheet, and then sintering to obtain the thermosensitive ceramic sheet with a silver layer printed on both surfaces;

S2: sputtering sequentially a titanium-tungsten alloy layer, a copper layer and a gold layer on the silver layer on one surface of the thermosensitive ceramic sheet obtained from Step S1; and S3: testing a resistivity of the thermosensitive ceramic sheet obtained from Step S2, calculating a size of the single thermistor chip according to the test result and required resistance of the thermistor chip, and then cutting the thermosensitive ceramic sheet into single thermistor chips.

8. The method of claim 7, wherein in Step S1, the sintering temperature is 850~870° C., and the holding time of the sintering is 15 minutes.

9. The method of claim 7, wherein in Step S2, a vacuum sputtering coating machine is used to sequentially sputter the titanium-tungsten alloy layer, the copper layer and the gold layer under a condition that argon gas is used as a working gas.

10. The method of claim 7, wherein in Step S2, before sputtering, the thermosensitive ceramic sheet is put into a plasma cleaning machine for cleaning and activating the surfaces.

11. The thermistor chip of claim 2, wherein a mass ratio of titanium to tungsten of the titanium-tungsten alloy layer of the bottom electrode is 1:9.

12. The thermistor chip of claim 2, wherein a thickness of the silver layer of the surface electrode is 4~7 microns.

13. The thermistor chip of claim 12, wherein a mass ratio of titanium to tungsten of the titanium-tungsten alloy layer of the bottom electrode is 1:9.

14. The thermistor chip of claim 1, wherein the titanium-tungsten alloy layer, the copper layer and the gold layer of the bottom electrode are all formed by sputtering.

15. The thermistor chip of claim 1, wherein the thermosensitive ceramic substrate is made from a negative temperature coefficient thermosensitive ceramic material.

* * * * *